US008231432B1

(12) United States Patent
Sutton et al.

(10) Patent No.: US 8,231,432 B1
(45) Date of Patent: Jul. 31, 2012

(54) OPTICAL POLISHING PITCH FORMULATIONS

(75) Inventors: Stephen P. Sutton, Mount Gilead, NC (US); William T. Sutton, Charleston, SC (US)

(73) Assignees: Stephen P. Sutton, Mt. Gilead, NC (US); Elizabeth H. Sutton, Mt. Gilead, NC (US)

( * ) Notice: Subject to any disclaimer, the term of this patent is extended or adjusted under 35 U.S.C. 154(b) by 0 days.

(21) Appl. No.: 13/191,817

(22) Filed: Jul. 27, 2011

Related U.S. Application Data

(63) Continuation of application No. 11/133,128, filed on May 19, 2005, now Pat. No. 7,988,534.

(60) Provisional application No. 60/572,319, filed on May 19, 2004.

(51) Int. Cl.
*B24B 1/00* (2006.01)

(52) U.S. Cl. ..... 451/42; 451/54; 451/63; 451/41

(58) Field of Classification Search ..... 451/28, 451/36, 41, 42, 54, 59, 63, 287, 495, 526
See application file for complete search history.

(56) References Cited

U.S. PATENT DOCUMENTS 3,915,602 A * 10/1975 Douglas ..... 417/554
4,000,140 A * 12/1976 Tierney ..... 524/69
4,221,700 A * 9/1980 Minagawa et al. ..... 524/128
4,277,387 A * 7/1981 Jordan et al. ..... 524/292
4,508,867 A * 4/1985 Sato ..... 524/434
4,900,617 A * 2/1990 Smith ..... 428/325
4,970,110 A * 11/1990 Miraldi ..... 427/389.9
5,149,338 A * 9/1992 Fulton ..... 51/293
5,176,152 A * 1/1993 Wheeler ..... 128/844
5,258,430 A * 11/1993 Bastioli et al. ..... 524/52
5,505,886 A * 4/1996 Baugh et al. ..... 264/102
5,584,898 A * 12/1996 Fulton ..... 51/309
5,632,668 A * 5/1997 Lindholm et al. ..... 451/42
5,650,106 A * 7/1997 Paquet et al. ..... 264/53
5,779,529 A * 7/1998 Bizer ..... 451/550
6,155,910 A * 12/2000 Lamphere et al. ..... 451/41
6,291,349 B1 * 9/2001 Molnar ..... 438/690
6,726,534 B1 * 4/2004 Bogush et al. ..... 451/36
6,796,883 B1 * 9/2004 Molnar ..... 451/41
6,812,982 B2 * 11/2004 Ishizuka et al. ..... 349/117
6,827,633 B2 * 12/2004 Wada et al. ..... 451/41
6,848,977 B1 * 2/2005 Cook et al. ..... 451/41
7,066,794 B2 * 6/2006 Granziera et al. ..... 451/158
7,077,879 B2 * 7/2006 Ogawa et al. ..... 51/298
7,098,255 B2 * 8/2006 Seyanagi et al. ..... 521/170
2003/0070967 A1 * 4/2003 Whitlock et al. ..... 209/127.1
2005/0101226 A1 * 5/2005 Ferme ..... 451/36
2005/0279451 A1 * 12/2005 Whitlock et al. ..... 156/304.5
2009/0280721 A1 * 11/2009 Hoon ..... 451/5

FOREIGN PATENT DOCUMENTS

WO 9522354 8/1995

* cited by examiner

*Primary Examiner* — Eileen P. Morgan
(74) *Attorney, Agent, or Firm* — Dority & Manning, P.A.

(57) ABSTRACT

Optical polishing pitch formulations include synthetic polymers or other synthetic resins. As alternatives to traditional optical pitches, these materials offer improved stability in use, storage, and processing. In addition, these pitch compositions may be masterbatched and manufactured with precision to ensure superior reproducibility and quality control in polishing performance.

20 Claims, No Drawings

OPTICAL POLISHING PITCH FORMULATIONS

CROSS REFERENCE TO RELATED APPLICATION

The present application is a continuation of U.S. application Ser. No. 11/133,128 filed on May 19, 2005, which claims benefit of U.S. Provisional Patent Application Ser. No. 60/572,319 entitled "Optical Polishing Pitch Formations" filed May 19, 2004, which are incorporated herein in their entirety by reference thereto.

BACKGROUND OF THE INVENTION

In the fabrication of precision optical components (telescope mirrors, lenses for imaging systems, laser windows, etc.), achievement of surface form and finish is critical. To rough out the basic optical form, any number of processes may be employed including diamond machining, abrasive grinding, or even molding. Such processes, however, produce only imprecise surface form and leave a rough surface finish. Even extremely fine grinding, using grit sizes in the few micron range, yields a microscopically pitted and frosty surface. Precision optical fabrication, therefore, requires a finishing step to achieve near molecular level smoothness and extreme accuracy in final surface figure. This final operation, commonly referred to as polishing, is generally critical within the field of precision optical fabrication.

Within the last few decades, tremendous advances have been made in the general art of surface polishing. Techniques such as chemical mechanical planarization (CMP) are now available for economical achievement of nanometer scale smoothness in semiconductor manufacturing. For optical polishing, magnetorheological finishing has proven value in specific precision finishing applications. For the manufacture of most precision optical components, however, traditional lap polishing remains the most economical and viable approach.

Remarkably, Sir Isaac Newton is credited with inventing the lap polishing method, which in essential respects is the basis for most modern precision optical finishing. Newton found that although fine grinding leaves optical surfaces microscopically pitted, an incredibly smooth finish might be obtained on glass (and like surfaces) if worked against a pitch material in the presence of a slurry containing soft abrasive particles. In the roughly 300 years since Newton originally published this technique, the basic methodology has become a staple optical finishing technique.

In pitch lapping, a hard support is typically coated with a layer of natural pitch, comprised of pine rosin or petroleum based resin, to form a lap of cut or molded pitch facets. Often, the pitch is melted, cast directly onto the support, cut into facets or, in some other fashion, molded into facets attached to the rigid support. Pitch, formulated for this application, displays slow creep or flow under the action of stress (although it outwardly appears as a hard resinous solid much like amber or hard sugar candy). Pressed against an optical workpiece, pitch facets slowly conform to provide an intimate mate with the surface. Subsequent working against the lap, in the presence of a particle slurry leads to charging of the lap surface with embedded particles. As a result, particles entrapped at the pitch surface are delicately dragged over the work and, through complex mechanisms, smooth the surface to produce an extremely high polish. Beyond polishing, lapping also delicately removes material from the optical surface and, thus, enables extremely fine adjustment of surface figure at the final stages of finishing.

Although the underlying mechanisms of pitch polishing remain a subject for investigation, pitch flow or creep is accepted as an important enabling phenomenon. Apparently, flow of the lap to mate with the optical surface is needed for the achievement of both uniform polish, and control of surface figure. Certainly, it is widely accepted that materials, which do not flow and conform to the optical work must either be preconditioned to provide conformance, or produce poor polishing results. Waxes, for example, produce a polishing effect but often with characteristic non-uniform lemon peel texture. Materials such as TEFLON fluorocarbon polymers may also be used for lapping but only following exhaustive diamond conditioning to provide close mating. Flow in pitch, thus, offers a practical means to achieve intimate microscopic lap mating and consequent polishing uniformity/control.

Due to the importance of flow in lap performance, optical polishing pitches are commonly formulated to possess levels of flow appropriate for a given application. The so called hardness of a pitch, or its resistance to flow in response to stress, is determined by mixing resins with different characteristics or plasticizing a given material with additives. Generally, pine rosin, plasticized with turpentine or other similar materials, has long been used as a polishing pitch. For example, one published account of a pitch formulation containing pine rosin dates back to the 1940s.

Currently, several brands of optical polishing pitch, blended to achieve different levels of hardness, are available commercially. Swiss manufactured GUGOLZ pitches, based on proprietary pine derivatives, are used extensively within the field of precision optics. Universal Photonics, Inc. of Hicksville, N.Y., also offers similar polishing pitches formulated across a very broad range of hardness. Beyond pine derivatives, Cycad Products, of Las Vegas, N. Mex., offers a range of pitches based on proprietary petroleum refining residuals and these pitches also find specific applications in optical finishing.

While the use of pine and petroleum resins as a base for optical polishing pitches has a long history, associated technology has specific limitations, which are addressed by the current invention.

Pine based pitches are typically derived from gum pine rosin, or similar related materials which, chemically, are largely comprised of materials refined from the sap of pine trees. While these materials are dominantly comprised of resin acids (such as abietic acid), exact weight distribution among these acids vary and many residual compounds are present depending on pine species, harvest location, and growing conditions. Consequently, the exact chemical makeup of pitches thus derived is difficult to control and, inherently, comprises an extremely complex blend of compounds, which are difficult to reproduce consistently over time. Similarly, petroleum based pitches, derived from refining residuals, contain a complex blend of isomers, oligimers, cyclic anthracitic compounds, and the like, depending on exact crude source.

While in principle it is possible to manufacture consistent optical pitches derived from either pine resin or petroleum pitch, chemical complexity and inconsistency in raw natural constituents present significant practical barriers the achievement of precise physical properties. Pine derivatives from a given source, such as Hercules, Inc. in Brunswick, Ga., for example, contain variable fractions of low molecular weight compounds, which, like turpentine added to deliberately induce creep characteristics, induce varying levels of hardness. Since even a fraction of one percent (by weight) of low molecular weight constituents changes flow characteristics dramatically, precise blending with additives to achieve precise pitch hardness is hampered by associated variability. Similarly, pitches derived from petroleum residuals contain small fractions of low molecular weight compounds, which vary in concentration and composition, leading to analogous difficulty in precision control of hardness.

Variability in the physical properties of natural pitches, particularly hardness, is a serious issue in the manufacture of precision optics. Since reproducibility in polishing operations depends upon the properties of the pitch employed, lot-to-lot variability in pitch characteristics translates into costly and unwanted process troubleshooting.

Notwithstanding ongoing efforts to characterize and track the lot-to-lot properties of existing natural pitches, variability is a major current issue for most manufacturers of precision optics. While quality control measurements of natural pitch characteristics may be employed to select and screen lots of material for a given finishing operation, such screening is time consuming and generally costly. Consequently, lower variability alternatives would represent a fundamental advancement in the art of optical polishing.

Beyond the issue of chemical purity and consistency in manufacture, existing pine and petroleum pitches are relatively unstable both during melt molding to produce laps and in use. Since the base resins typically comprise low molecular weight components, melting or long-term exposure to air can lead to significant changes in hardness due to loss of low boiling volatiles. For this reason, opticians must take great care in the melting of pitch (to fabricate laps) such that exposure to high temperature and drying/hardening of the material is limited. In addition, laps constructed of such pitches have a limited life in part due to drying of volatiles from the material and consequent hardening.

It is also important to recognize that many existing natural pitch formulations, particularly those comprising pine derivatives, are subject to reactions with oxygen over time. Most pine derivatives, for example, become rancid much like unsaturated fats or cooking oils, within a few weeks on exposure to air due to oxidative reactions. Although formulation with additives may inhibit such reactions to some extent, oxidation is another inherent instability associated with natural resins.

In large part due to the above issues, current practitioners in the art of pitch polishing face many practical complexities and must, in general, develop considerable formulation and processing expertise to achieve success. Blending of different commercial pitches is often required to overcome variability in hardness and or polishing performance. All too often, trial and error blending to modify hardness, enhance surface wetting, or insure proper charging with polishing agents, is necessary. In addition, extreme care is required in molding of natural pitches to prevent, degradation or drying of the material during melt processing, requires considerable care and experience. While many opticians have developed remarkable skill and intuition in the general art of pitch manipulation, more stable and pure materials, having precise and controlled properties, would enable more systematic, and less costly, optical process engineering. In general, the ability to scientifically formulate exact hardness targets, utilizing materials having known chemistry in combination with additives yielding well-characterized effects, would be of great value in many optical polishing applications.

What is needed, therefore, are pitch materials comprising chemically pure substances, which may be precisely formulated to yield precision control of physical properties including pitch hardness. In addition, such materials are needed which do not contain significant volatile content and, thus, are not susceptible to drying over time or during melt processing. Finally, optical polishing pitches, which are impervious to oxidation on exposure to air, are generally needed in the art.

BRIEF SUMMARY OF THE INVENTION

The present application is generally directed to specific synthetic polymers and resins, which when blended with plasticizing additives exhibit creep or flow characteristics analogous to those of existing optical polishing pitches. Given the synthetic and highly processed nature of these polymers and resins, associated chemical composition is relatively pure. Thus, with appropriate choice of pure additives to induce creep, these materials enable precise formulation to achieve exact composition targets and precision control of material properties. These materials enable lap polishing much like existing natural pitch counterparts.

Beyond the ability to formulate polymeric or synthetic resin materials having appropriate flow characteristics for use as pitches in optical polishing, we further find that specific embodiments of these materials are highly stable both with respect to loss of volatiles and oxidation. With appropriate choice of resin and additives, formulations are disclosed which do not display significant changes in physical properties as a consequence of melt processing and/or long-term exposure to air during use or storage.

In an embodiment of the present invention, a synthetic optical polishing pitch is formulated for polishing an optical surface. The synthetic optical polishing pitch can include a synthetic polymeric substance such as a poly(alpha-methyl) styrene polymer. More particularly, the polymeric substance can be the poly(alpha-methyl)styrene, a vinyl, a polystyrene, a polymer resin, or any combination of these materials.

In this aspect of the invention, the optical polishing pitch can further include a plasticizer mixed with the synthetic polymeric substance. The plasticizer can be an oil such as a mineral oil, which induces creep into the polymeric substance. In other words, the oil affects viscosity and malleability of the polymeric substance. By way of example, Duoprime® 200 mineral oil can be utilized as the plasticizer. A ratio of the plasticizer to poly(alpha-methyl)styrene polymer is about 50-50 to about 11-89 by weight. Alternatively, the ratio can be about 11-89 to about 8-92 by weight, or about 8-92 to about 1-99 by weight.

Also in this aspect of the invention, the optical polishing pitch can include a colorant mixed with the synthetic polymeric substance to affect opacity of the mixture and thus opacity of the optical surface. A wax such as beeswax can also be mixed with the synthetic polymeric substance to affect a surface characteristic of the optical pitch.

In another embodiment of the present invention, an optical polishing pitch for polishing an optical surface can be an artificial resin such as Regalrez® resin, Kristalex® resin, Kristalex® 3085 resin Piccotex® resin, a hydrogenated pine resin derivative or any man-made resin similar to these exemplary resins, including any combination of these artificial resins.

As in the foregoing embodiment, the artificial resin can be mixed with a plasticizer, such as a mineral oil, in various ratios to affect of viscosity and malleability of the resin. For example, the resin and the plasticizer can mixed in a range of 50/50 to 11/89 by weight. More particularly, the ratio can be within the range of 11/89 to 8/92 by weight, or within the range of 8/92 to 1/99 by weight. As noted above, Duoprime® 200 mineral oil, or equivalent oil, can be used as the plasticizer.

In another embodiment of the invention, a method of preparing an optical polishing pitch includes the steps of heating a synthetic pitch material until molten; mixing a plasticizing agent with the synthetic pitch material to form a pitch mixture; solidifying the pitch mixture; bonding the pitch mixture to an optical surface such as by heating the pitch mixture, the optical surface or both; and working the pitch mixture on the optical surface to attain a polished optical surface.

In the exemplary method, the synthetic pitch material can be a polymeric material, an artificial resin, a hydrogenated pine resin derivative and combinations of these materials. As in the previous aspects of the invention, the plasticizing agent can be an oil such Duoprime® 200 mineral oil. Also similar to the foregoing aspects of the invention, the plasticizing agent and the synthetic pitch material can be mixed in various ratios to affect creep, such as about 50-50 to about 1-99 by weight.

Further, according to the method, the synthetic pitch material is heated in an oven at a temperature greater than 135 degrees Celsius for about 1 hour to about 4 hours. Once the synthetic pitch material nears liquification, the plasticizing agent and the synthetic pitch material are mixed by stirring until a homogeneous liquor is obtained, which may exhibit a clear, yellowish appearance.

The method can include the additional step of adding a porous particulate such as alumina to the plasticizing agent and the synthetic pitch material to enhance surface charging for working the pitch mixture.

The method can also include the steps of adding a wax such as beeswax to the plasticizing agent and the synthetic pitch material to affect a surface characteristic such as to enhance surface charging for working the pitch mixture.

In yet other steps, the method can include adding a colorant such as carbon black to the plasticizing agent and the synthetic pitch material to affect opacity and pigmentation of the pitch mixture and thus, opacity of the optical surface after polishing.

The method can also include the steps of adding shellac or a similar material to the plasticizing agent and the synthetic pitch material to enhance toughness of the polished optical surface.

Still further, the pitch mixture, when disposed on the optical surface, can be wetted such as with a soap and water solution and pressed on the optical surface for a period of about 30 minutes to about 8 hours to conform the pitch mixture to the optical surface before polishing.

To polish the optical surface, the method can include the additional step of coating the pitch mixture on the optical surface with cerium oxide powder and water slurry to work the pitch mixture.

DETAILED DESCRIPTION OF THE INVENTION

It is to be understood by one of ordinary skill in the art that the present discussion is a description of exemplary embodiments only and is not intended as limiting the broader aspects of the present invention.

In embodiments of the invention, thermoplastic polymers or resins are mixed, via melt processing or other means, with appropriate plasticizing agents (fluids or lower molecular weight polymers), to form a homogeneous mixture. Constituents are chosen to insure that the resultant mixture, owing to interaction between components, displays rheological characteristics enabling application as an optical polishing pitch. Preferably, constituents are further chosen to possess low volatile content, and stability against oxidation, to yield stable pitches, which can be precision, formulated and manufactured.

Although the rheology of natural polishing pitches is complex, and the molecular mechanisms which drive related characteristics in embodiments of the present invention are not completely understood, it is clear that many polymers and resins, when mixed with plasticizing fluids, display characteristics enabling use in polishing. Whatever the mechanisms, it is the creep phenomenon itself, initiated by the interaction of a plasticizing agent dissolved within a polymer or resin system, which is most relevant to the present invention. Ultimately, in fact, it is the ability to utilize embodiments of the invention in optical lapping which is crucial, notwithstanding overall rheological properties.

Because the mechanisms of plasticizer-induced creep are partially understood, polymer chemistries and characteristics appropriate for use in the invention are found empirically. Within a given polymer or resin chemistry, trials are carried out with suitable plasticizing agent candidates to determine whether homogeneous mixtures can be produced, and, most importantly, whether resultant blends exhibit appropriate creep. Typically, a small quantity of a particular polymer or resin is melted, or heated to high temperature, in the presence of the candidate plasticizer, and mechanically blended to achieve a homogenous mixture. If the blend remains homogenous upon cooling, the resultant material is tested to determine creep characteristics. Provided the material displays continuous flow when exposed to stress, relative concentrations of the constituents may be varied to determine formulation parameters sufficient to yield creep appropriate for optical polishing. Polishing trials, within a given application, may then be used, just as with natural pitch, to optimize the formulation.

Through the use of this methodology, a wide range of polymers and resins have been found which may be plasticized with specific fluids to yield materials suitable for use as optical polishing pitches. In addition, various materials have been found which, generally, do not yield suitable results. Although these results seem to indicate that certain classes of polymers are generally more suited for use in the present invention, observations of suitability are provided herein solely for the purpose of outlining preferred embodiments, but, in no way, are intended to limit the scope of the invention. Notwithstanding the finding of unsuitable specific polymers within a given polymer family, for example, subsequent application of the novel methods and concepts disclosed may lead to development of viable pitches using other fluids or polymers within the same category.

In general, we have found that many polymers, which tend to display less crystalline order, are good candidates for screening and trial for use in embodiments of the invention. We speculate that polymer molecules, which pack poorly and fail to crystallize, especially when intimately mixed with compatible lower molecular weight molecules, are sufficiently mobile within the disordered structure to enable slow flow in response to stress. Provided this is true, more crystalline polymers would tend to be more stable, even when heavily plasticized, due to tight packing, lower mobility, and a tendency towards crystallite separation from plasticizer rich domains. Notwithstanding this speculation, it is likely that both highly crystalline and more amorphous polymers may be utilized in specific embodiments of the present invention, although more crystalline choices may be more restrictive with respect to applicable plasticizers, and breadth of formulation parameters.

Among the vast number of polymers appropriate for use in the invention, those that are highly amorphous, commercially available in a wide range of molecular weights, cost effective, and highly chemically stable, are among the preferable choices. Such polymers include, but are not limited to, vinyls, polystyrenes, poly(alpha-methyl)styrenes, and cuomorone-indene resins. The most preferable polymers are brittle, highly amorphous materials which dissolve easily in solvents, such as acetone, commonly used for cleanup in optical shops. Specific grades of the Piccotex®, Kristalex®, and Regalrez® poly(alpha-methyl)styrene resins, for example, manufactured by the Eastman Chemical Company of Bristol, Tenn., are particularly well suited for application in embodiments of the present invention.

Any number of relatively pure, non-polymeric synthetic resins may also be employed in embodiments of the present invention. Synthetically hydrogenated abietic acid, synthesized from highly processed pine derivatives, for example, may be plasticized with various non-volatile oils and low molecular weight polymers to yield materials which exhibit continuous creep and which are appropriate for use as optical polishing pitches. Such materials are highly differentiated from existing natural polishing pitches in that the base resin is man synthesized from relatively pure, and highly processed, chemical species. In addition, these base resins are far more chemically stable, with respect to oxidation even at high temperatures, than unmodified natural pine resin counterparts. Generally, therefore, a wide class of other synthetically manufactured materials, which are not rigorously polymers, but which possess the desirable attributes of man made pure and stable chemistries, are useful in embodiments of the present invention. Such materials include, but are not limited to synthetic esters and like resins.

Plasticizer agents appropriate for use in the invention include substantially non-volatile fluids and resinous liquids. Plasticizers are used as softening agents and provide low temperature flexibility and weldability. Most preferably, such materials do not display significant evaporation at room temperature, such that resultant blends will not dry and change properties during manufacture, melt processing, use, or storage. Also, substantially hydrogenated or other chemistries are preferred which generally resist oxidation, or other chemical instability, at temperatures likely encountered in melt molding by opticians (up to temperatures of approximately 150° C.). In addition, plasticizing agents should be available in forms that, although not necessarily of exact chemical purity or single species, may be obtained over long periods of time having highly reproducible chemical composition.

Beyond these general characteristics, plasticizing agents must be compatible within the base polymer or resin selected for use in a given embodiment. Accordingly, the plasticizer should form a homogeneous and substantially stable composition when intimately mixed and blended into the base polymer or resin. In addition, it is imperative that the chosen plasticizer interact within the polymer matrix to enhance the tendency of the resultant composition towards continuous creep, enabling application in optical lapping.

Generally, the range of plasticizing agents which may be employed in the present invention is extremely broad and many commercial oils, plasticizers, tackifying agents, low molecular weight polymers, and the like, are appropriate for use in specific embodiments. Many base polymers and resins, including but not limited to, poly(alpha-methyl)stryrenes, may be plasticized with any number of mineral oils, including, but not limited to, various grades of the Citgo Duoprime® oils. Many other chemically compatible plasticizers are also commonly available including technical grades of mineral oil, glyceride oils, silicone oils, and many others. Low molecular weight polymers are also highly suitable for use including very low molecular weight species of polymers useful as base resins (low molecular weight fluidic Kristalex® resins, for example, are highly useful as plasticizers for Kristalex® and other specific polymers).

In the most basic embodiment of the invention, wherein an appropriate polymer or resin is blended with a suitable plasticizer, the compositional fraction of plasticizer may vary according to specific desired creep characteristics. Since the plasticizer serves to induce or enhance continuous creep, a higher fraction of this component is employed in situations requiring compliance on a short time-scale, and lower fractions are employed in situations requiring slower creep response.

In some embodiments of the present invention, wherein the base resin is a poly(alpha-methyl)styrene, polymer molecular weight is chosen to enable plasticization with non volatile and relatively stable oils having intermediate molecular weight. For example, various oils may be chosen that have a viscosity of from about 15 to about 70 cSt at 40° C. according to test ASTM D 445, such as from about 20 to about 60 cSt or from about 28 to about 50 cSt. When the viscosity is measured according to test no. ASTM D 2161, on the other hand, the oil may have a viscosity of from about 80 SUS to about 400 SUS at 100° F., such as from about 100 SUS to about 350 SUS, and more particularly from about 180 SUS to about 240 SUS.

Kristalex® 3085, for example, is found to yield a preferred range of compositions when blended with intermediate molecular weight mineral oils, such as Citgo Duoprime® 200, in the range of 1 to 25 percent by weight, and most preferably, when blended in the range of 2 to 11 percent by weight. When other polymers are employed, however, the useful range of plasticizer will depend on the exact makeup of the constituents, and associated interactions, to result in creep. Compositions in such embodiments, therefore, vary over a range that must be determined empirically.

As one of ordinary skill in the art will recognize, the base polymer or resin component utilized in embodiments of the present invention may itself, comprise a blend of polymers, synthetic resins, or polymers and synthetic resins, suitable for appropriate plasticization. Blends of different Regalrez® resins, for example, having different average molecular weight, would be entirely appropriate for use in specific embodiments. Similarly, the plasticizer agent may comprise a blend of one or more individual components, having different chemical composition (a blend of different Duoprime® oils for example).

One of ordinary skill in the art will further recognize that modifying additives may be incorporated within the basic synthetic compositions described herein, to optimize and enhance specific properties which impact lapping performance. In common natural optical pitch formulations, walnut shell flour, and various other porous wettable particulates are often incorporated, beyond the basic resin composition, to enhance surface charging with polishing agents and water wettability during lap polishing. Waxes, including beeswax, may also be incorporated to enhance charging and or manipulate surface characteristics. Colorants, such as carbon blacks, are often incorporated to manipulate opacity and pigmentation. Even materials such as shellac are commonly incorporated to enhance toughness and modify texture. In an exactly analogous fashion, these same modifiers, or similar materials, may be incorporated into the synthetic compositions described herein, to effect similar modification. Synthetic pitches, modified in this fashion are thus, also embodiments of the present invention.

Example 1

A 10 percent blend, by weight, of Duoprime® 200 oil in Kristalex® 3085 resin was produced via melt blending. In a stainless steel pot, 17.10 pounds of Kristalex® 3085 resin, lot number JP1L1291, was mixed with 1.90 pounds of Citgo Duoprime® 200 oil, lot number 4144S0223, and heated in an oven at a temperature of 135° C. for a period of 4 hours. The molten material was manually stirred, using a paddle, until a homogeneous, clear yellowish, liquor was obtained.

The molten material was ladled into a series of containers and allowed to cool in ⅓ Kg blocks. One of these blocks was fractured to produce small pieces, several of which were welded together using a heat gun to produce a solid chunk Which, following heating in hot water, was precisely rolled into a cylinder 0.74 inches in diameter. This cylinder was fractured to approximate length, roughly shaved using a razor blade, and sanded on its ends, to produce a precise cylinder 1.5 inches in length.

The ends of this cylinder were lubricated using silicone oil (Dow SF96-1000) and it was placed between two polished stainless steel platens, with the cylinder ends bearing flat on each platen. The sample was precisely equilibrated at a temperature of 22.5° C. A compressive force was then applied between the platens placing the sample under a compressive longitudinal stress of $8.2\times10^4$ Pascals. The sample was observed to exhibit continuous creep, decreasing in length at a strain rate of $2.7\times10^{-4}$/s. A measure of sample compliance and creep, given by the stress divided by the strain rate, was calculated as 0.30 GPa-s. We note that under specific assumptions, including perfect slip boundary conditions at the platen interfaces and exact cylindrical symmetry in sample flow, this compliance value reduces to the Trouton viscosity of the material at this strain rate.

For reference only, a similar measurement was carried out on a sample of GUGOLZ 55 polishing pitch (lot number 208009) prepared in the same fashion and tested under similar conditions. The resultant sample compliance was calculated (as above) to be 0.36 Gpa-s, comparable to that of the 10 percent formulation above, We noted, therefore, a reasonable equivalence in creep characteristics between the 10 percent composition, and this particular lot of commonly used natural polishing pitch. We further note, however, that given the variability common in GUGOLZ pitch, and aging effects during storage in GUGOLZ pitch, this measurement is in no way intended to be reproducible in the future. Rather, it provided a comparison indicating a very general equivalency with a particular GUGOLZ 55 lot sold by Universal Photonics Inc. of Hicksville, N.Y.

Subsequently, another ⅓ Kg block of the 10 percent blend was cut into tiles, measuring approximately ¾ inch on a side and ¼ inch in thickness, and used to tile the surface of a 6 inch diameter glass blank 0.75 inches in thickness. Tiles were arranged, and bonded to the glass surface using a heat gun, in a square pattern leaving ⅛ inch gaps between tiles.

The resultant lap was wetted with soapy water and pressed with an optical flat for a period of 30 minutes. The tiles conformed to mate with the flat and conform across the entire lap surface, forming a well-conditioned flat surface for trial in polishing. A 3 inch diameter trial blank of Pyrex® glass was precision flat ground using a final alumina particle size of 9 microns. Cerium oxide powder, wetted with water on the finger, was coated on the surface of this trial blank and worked over the lap. As with normal pitch, a few minutes of working brightened the fine ground surface from having a frosty finish to show significantly polished appearance. Subsequent working, with cerium oxide slurry, produced a finished, highly polished, flat optical surface.

Example 2

A 4 percent blend, by weight, of Duoprime® 200 oil in Kristalex® 3085 resin was produced via melt blending. In a stainless steel cup, 240 g of Kristalex® 3085 resin, lot number JP1L1291, was mixed with 10 g of Citgo Duoprime® 200 oil, lot number 4144S0223, and heated in an oven at a temperature of 135° C. for a period of 1¾ hours. The molten material was manually stirred, using a spoon, until a homogeneous, clear yellowish liquor was obtained.

The molten material was ladled into a series of containers and allowed to cool in ⅓ Kg blocks. One of these blocks was fractured to produce small pieces, several of which were welded together using a heat gun to produce a solid chunk which, following heating in hot water, was precisely rolled into a cylinder 0.73 inches in diameter. This cylinder was fractured to approximate length, roughly shaved using a razor blade, and sanded on its ends, to produce a precise cylinder 1.64 inches in length.

The ends of this cylinder were lubricated using silicone oil (SF96-1000) and it was placed between two polished stainless steel platens, with the cylinder ends bearing flat on each platen. The sample was precisely equilibrated at a temperature of 22.5° C. A compressive was then applied between the platens placing the sample under a compressive longitudinal stress of $9.0\times10^4$ Pascals. The sample was observed to exhibit continuous creep, decreasing in length at a strain rate of $1.6\times10^{-6}$/s. A measure of sample compliance and creep, given by the stress divided by the strain rate, was calculated as 55 GPa-s. We note that under specific assumptions, including perfect slip boundary conditions at the platen interfaces and exact cylindrical symmetry in sample flow, this compliance value reduces to the Trouton viscosity of the material at this strain rate.

Subsequently, pieces of this material were cut into tiles, measuring approximately ¾ inch on a side and ¼ inch in thickness, and used to tile the surface of a 6 inch diameter glass blank 0.75 inches in thickness. Tiles were arranged, and bonded to the glass surface using a heat gun, in a square pattern leaving ⅛ inch gaps between tiles.

The resultant lap was wetted with soapy water and pressed with an optical flat for a period of 8 hours. The tiles conformed to mate with the flat across the entire lap surface, forming a well-conditioned flat surface for trial in polishing. A 3-inch diameter trial blank of Pyrex® glass was precision flat ground using a final alumina particle size of 9 microns. Cerium oxide powder, wetted with water on the finger, was coated on the surface of this trial blank and worked over the lap. As with normal pitch, a few minutes of working brightened the fine ground surface from having a frosty finish to show significantly polished appearance. Subsequent working, with cerium oxide slurry, produced a finished, highly polished, flat optical surface.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged either in whole or in part. Furthermore, those of ordinary skill in the art will appreciate that the foregoing description is by way of example only, and is not intended to limit the invention so further described in such appended claims.

That which is claimed is:

1. A method of polishing an optical surface comprising:

providing a synthetic optical polishing pitch formulated for polishing the optical surface, the optical polishing pitch comprising a plasticizer mixed with a synthetic polymeric substance, the plasticizer being combined with the synthetic polymeric substance in an amount sufficient to promote and maintain continuous creep during and through the end of the polishing operation;

wherein a ratio of the plasticizer to the synthetic polymeric substance is about 50-50 to about 1-99 by weight;

applying the synthetic optical polishing pitch to a lap;

contacting the optical surface with the polishing pitch applied to the lap;

lapping the optical surface by pressing it against the lap with the synthetic optical polishing pitch in the presence of an optical polishing slurry comprising particles that become charged or embedded in the optical polishing pitch surface during lapping such that the particles wear away the optical surface to obtain a highly polished optical surface.

2. The method of polishing an optical surface as in claim 1, wherein the polymeric substance is a poly(alpha-methyl)styrene polymer.

3. The method of polishing an optical surface as in claim 1, wherein a ratio of the plasticizer to the synthetic polymeric substance is about 50-50 to about 11-89 by weight.

4. The method of polishing an optical surface as in claim 1, wherein a ratio of the plasticizer to the synthetic polymeric substance is about 11-89 to about 8-92 by weight.

5. The method of polishing an optical surface as in claim 1, wherein a ratio of the plasticizer to the synthetic polymeric substance is about 8-92 to about 1-99 by weight.

6. The method of polishing an optical surface as in claim 1, wherein the plasticizer is a mineral oil, the mineral oil configured to induce creep into the synthetic polymeric substance.

7. The method of polishing an optical surface as in claim 1, further comprising a colorant mixed with the synthetic polymeric substance to affect opacity of the mixture.

8. The method of polishing an optical surface as in claim 1, further comprising a wax mixed with the synthetic polymeric substance to affect a surface characteristic of the optical pitch.

9. The method of polishing an optical surface as in claim 1, wherein the polymeric substance is selected from the group consisting of a vinyl, a polystyrene, a poly(alpha-methyl) styrene, a polymer resin, and combinations thereof.

10. The method of polishing an optical surface as in claim 1, wherein the optical polishing slurry comprises an oxide powder.

11. The method of polishing an optical surface as in claim 10, wherein the slurry comprises cerium oxide powder.

12. The method of polishing an optical surface as in claim 1, wherein the optical polishing slurry comprises an abrasive.

13. A method of polishing an optical surface comprising:

providing a synthetic optical polishing pitch formulated for polishing the optical surface, the optical polishing pitch comprising a plasticizer mixed with a synthetic polymeric substance, the plasticizer being combined with the synthetic polymeric substance in an amount sufficient to promote and maintain continuous creep during and through the end of the polishing operation;

wherein a ratio of the plasticizer to the synthetic polymeric substance is about 50-50 to about 1-99 by weight;

applying the synthetic optical polishing pitch to a polishing member;

placing the polishing member with the applied polishing pitch in contact with the optical surface;

lapping the optical surface by pressing it against the polishing member with the synthetic optical polishing pitch in the presence of an optical polishing slurry comprising oxide particles that become charged or embedded in the optical pitch surface during lapping and wear away the optical surface to obtain a highly polished optical surface.

14. The method of polishing an optical surface as in claim 13, further comprising pressing the polishing member and the optical member together to conform the polishing pitch to the optical surface before lapping the optical member and the polishing member against one another.

15. The method of polishing an optical surface as in claim 14, wherein the optical member and polishing surface are pressed together for a period of time from about 30 minutes to 8 hours before lapping.

16. A method of polishing an optical surface comprising:

providing a synthetic optical polishing pitch formulated for polishing the optical surface, the optical polishing pitch comprising a plasticizer mixed with a synthetic polymeric substance, the plasticizer being combined with the synthetic polymeric substance in an amount sufficient to promote and maintain continuous creep during and through the end of the polishing operation;

wherein a ratio of the plasticizer to the synthetic polymeric substance is about 50-50 to about 1-99 by weight;

applying the synthetic optical polishing pitch to a lap;

contacting the optical surface with the polishing pitch applied to the lap;

introducing to the synthetic optical polishing pitch a slurry comprising cerium oxide particles that become charged or embedded in the optical polishing pitch surface; and lapping the optical surface by pressing it against the lap with the synthetic optical polishing pitch to obtain a highly polished optical surface in the presence of the slurry by wearing away the optical surface via the cerium oxide particles.

17. The method of polishing an optical surface as in claim 16, wherein the slurry comprises cerium oxide powder.

18. The method of polishing an optical surface as in claim 16, wherein the slurry comprises water.

19. The method of polishing an optical surface as in claim 16, further comprising adding a porous particulate to enhance surface charging.

20. The method of polishing an optical surface as in claim 19, wherein the porous particulate comprises alumina.

* * * * *